US007976444B2

(12) United States Patent
Binns et al.

(10) Patent No.: US 7,976,444 B2
(45) Date of Patent: Jul. 12, 2011

(54) SHOULDER REHABILITATION AND EXERCISE DEVICE

(76) Inventors: Matthew Binns, Chicago, IL (US); Eugene David Protas, League City, TX (US); Scott Avenarius, Des Plaines, IL (US)

( * ) Notice: Subject to any disclaimer, the term of this patent is extended or adjusted under 35 U.S.C. 154(b) by 511 days.

(21) Appl. No.: 12/156,199

(22) Filed: May 30, 2008

(65) Prior Publication Data

US 2008/0300511 A1 Dec. 4, 2008

Related U.S. Application Data

(60) Provisional application No. 60/941,168, filed on May 31, 2007.

(51) Int. Cl.
*A63B 21/008* (2006.01)

(52) U.S. Cl. ..... 482/114; 482/92; 482/904; 601/33

(58) Field of Classification Search ..... 482/44, 482/92, 111–115, 133–139, 148, 904, 905, 482/908–910; 473/229, 258, 259; 601/5, 601/23, 33

See application file for complete search history.

(56) References Cited

U.S. PATENT DOCUMENTS

| | | | | | |
|---|---|---|---|---|---|
| 2,817,524 | A | | 12/1957 | Sadler | |
| 3,042,023 | A | * | 7/1962 | Yates | 601/33 |
| 3,785,657 | A | * | 1/1974 | Moller | 473/229 |
| 3,926,430 | A | * | 12/1975 | Good, Jr. | 482/112 |
| 4,570,925 | A | * | 2/1986 | Kock et al. | 482/46 |
| 4,603,856 | A | * | 8/1986 | Fiore | 482/114 |
| 4,772,015 | A | * | 9/1988 | Carlson et al. | 482/92 |
| 4,817,943 | A | * | 4/1989 | Pipasik | 482/97 |
| 4,878,663 | A | | 11/1989 | Luquette | |
| 4,957,281 | A | * | 9/1990 | Christolear, Jr. | 482/100 |
| 5,080,350 | A | | 1/1992 | Shoefiled et al. | |
| 5,125,844 | A | * | 6/1992 | Grant et al. | 434/252 |
| 5,645,521 | A | * | 7/1997 | Hepburn et al. | 601/33 |
| 5,713,370 | A | * | 2/1998 | Cook | 600/595 |
| 6,824,498 | B2 | | 11/2004 | Hassler | |
| 7,252,644 | B2 | | 8/2007 | Dewald et al. | |
| 7,491,158 | B1 | * | 2/2009 | Danaei-Boroumand | 482/110 |
| 7,621,857 | B2 | * | 11/2009 | Pompile | 482/129 |
| 2002/0107116 | A1 | * | 8/2002 | Schulz | 482/97 |
| 2006/0293617 | A1 | * | 12/2006 | Einav et al. | 601/33 |
| 2008/0153682 | A1 | * | 6/2008 | Chen et al. | 482/136 |

* cited by examiner

*Primary Examiner* — Loan Thanh
*Assistant Examiner* — Daniel F Roland
(74) *Attorney, Agent, or Firm* — Richard L. Strauss, Esq.

(57) ABSTRACT

A shoulder rehabilitation and exercise device is disclosed which enables a user to perform internal and external rotations of both right and left shoulder. The device is comprised of a base plate, hydraulic damper, restrictor arm, actuator arm, elbow cup and hand grip. A smooth, fluid-like movement is achieved during performance of arcuate internal and external shoulder rotations while also providing automatic increases and decreases in resistance to such motion in response to user effort. In certain preferred embodiments, in addition to such automatic adjustment of resistance, the device includes a means of manually adjusting resistance. The device may be utilized to perform the aforementioned internal and external rotations on a user's right or left side without need for making any adjustments to the machine. Range of motion limitations may be set to control the arcuate degree of internal and external rotations performed. Adjustment in the elevation of a user's forearm via adjustment of the actuator arm is provided. The actuator arm includes an adjustable elbow cup and adjustable hand grip. The device does not store potential energy or produce sufficient momentum to oppose a user's immediate and safe termination of motion.

21 Claims, 10 Drawing Sheets

SHOULDER REHABILITATION AND EXERCISE DEVICE

RELATED APPLICATIONS

This application claims the benefit of U.S. Provisional Application No. 60941168 filed on May 31, 2007.

TECHNICAL FIELD

The present invention relates to the field of rehabilitation and exercise equipment. More specifically, a rehabilitation and exercise device is disclosed herein specifically adapted and configured to enable a user to strengthen and increase the range of motion of muscles associated with internal and external rotation of the shoulder.

BACKGROUND OF THE ART

The shoulder joint is the most mobile and flexible joint in the human body. This joint controls the position of the upper arm and, due to the high flexibility of the joint, enables a tremendous range of motion. However, due largely to its high flexibility, the shoulder is frequently subject to injury leading to pain, inflammation and loss of motion. The humerus and the scapula are the two major components of the shoulder joint with a portion of the head of the humerus functioning substantially as a ball positioned in a rather shallow cup-like area of the scapula known as the glenoid fossa. Smooth articular cartilage covers both the head of the humerus and the glenoid fossa and, together with the action of synovial fluid, allows these surfaces to glide with little friction. The joint capsule comprised of strong ligaments connects the head of the humerus to the scapula at the glenoid fossa so as to both secure and help define the joint and resist dislocation.

Muscles attached to different parts of the shoulder are utilized to enable the upper arm to move. The deltoid is a large muscle attached medially to the scapula along the acromion and also attached to a portion of the clavicle. The lateral portion of the muscle crosses the shoulder joint and is attached to the humerus about halfway down its length. The deltoid is the strongest of the shoulder muscles. Its function is to raise the arm upward (or abduction).

Internally disposed in relation to the deltoid muscle, a group of muscles known as the "rotator cuff" helps stabilize the joint as well as enable further movements of the arm. More specifically, the rotator cuff is a group of four muscles forming a strong "cuff" about the joint formed by the head of the humerus and glenoid fossa. In addition to helping to stabilize this joint, these muscles provide rotation and stabilize position of the arm. The four muscles of the rotator cuff are the subscapularis; supraspinatus; infraspinatus and teres minor.

The subscapularis muscle is attached to the deep surface of the scapula and then passes in front of the humeral head. It inserts into the humerus at the lesser tuberosity. This muscle is used to internally rotate the shoulder (and arm) and to bring the arm down to the side of the body (a motion that is called "adduction"). Ordinarily, internal rotation of the shoulder, or abduction, results in rotation of the arm so that the palmar surface of the hand turns away from the body as the dorsum of the hand approaches the trunk. For example, internal rotation of the right shoulder ordinarily results in a counter-clockwise rotation of the right hand and internal rotation of the left shoulder results in a clock-wise rotation of the left hand.

The three remaining muscles of the rotator cuff each have medial insertions at posterior surface of the scapula and then extend posterior to the humeral head where each continue on to insert at the greater tuberosity of the humerus. Such insertions and path enable these muscles to externally rotate the shoulder (and, in regard to supraspinatus) abduct (or move the arm outward, away from the side of the body).

Each of the muscles of the rotator cuff are susceptible to injury such as sprains and muscle tears which can be debilitating. The supraspinatus muscle and tendon is especially susceptible to such injury and is the most commonly injured part of the rotator cuff due, in large part, to its position and path of contraction. However, any of these muscles and associated tendons can an are involved in rotator cuff injuries.

It is known that strengthening the rotator group of muscles through exercise can greatly reduce the chance of rotator cuff injury and/or re-injury. For this reason, it is also well known to perform internal and external rotations of the shoulder to keep these muscles in top condition. Such exercise is also utilized as part of rehabilitation programs for treatment of rotator cuff injuries. More specifically, such rehabilitation programs often progress from passive range of motion exercises to active-assisted range of motion exercise to strengthening exercises.

In the past, strengthening exercises for the rotator cuff muscles—including those used for rehabilitation and for prevention of injuries—included external rotation and internal rotation of the shoulder utilizing, for example, hand weights. Utilizing such weights, an individual might, for example lie on their side on the floor or a exercise bench with their upper arm parallel to their body and lower arm held 90 degrees in relation to the upper arm. Thereafter, the shoulder could be internally or externally rotated, while holding a weight, to perform resistive training.

Utilizing free weight exercise was of limited value in that, depending upon the user's position, it is difficult to obtain consistent resistance through, for example, a complete 180 degrees of internal or external rotation. A handheld weight, following an arch-like movement, will not provide consistent resistance. For example, when the user's shoulder is positioned so that the lower arm lies vertical (plumb), there is substantially no force exerted upon the rotator cuff muscles. However, as the shoulder rotates and the lower arm approaches a position parallel with the floor, the force provided by the weight acting upon the rotator cuff muscles will increase. Such exercises also require utilizing different barbells when greater or lesser resistance is required. Such techniques also make no allowance for control and achievement of a safe range of motion. Holding a free weight by hand, especially in regard to a rehabilitation exercise, may be dangerous in that the potential energy associated with the weight might cause a user to over-extend his or her movements—go beyond a range of motion in which such movement is safe—. Such free weight exercises make no provision for controlling range of motion (ROM). Also, if a user should suffer a spasm, sudden pain or lose consciousness, the potential energy stored in the free weight or the momentum developed could cause further injury to the user or others. In addition, performing both internal and external rotation of the shoulder with weights would most likely require a user to continually change position.

It has also been known, in the past, to utilize elastic bands and pulleys to exercise the muscles of the rotator cuff. More specifically, internal and external rotations of the shoulder have been accomplished utilizing an elastic band (or tube) fixed to a support, such as a door or pole. In such exercise, the individual may stand, sit or kneel, with her upper arm aligned with her torso and lower arm positioned at about 90 degrees in relation to the upper arm. Thereafter, the user grasps the free end of the tube or band and performs the desired rotation which is resisted by the elastic material. However, utilizing such an exercise device subjects a user to varying amounts of resistance as the band or tube is stretched and, similar to the use of weights, subjects the user to the danger of stored potential energy within the elastic posing a danger of injuring the user. Also, such elastics require the user to change position when he or she wishes to change from internal to external rotation exercises.

Pulley devices utilizing weights have also been known to be utilized for performing internal and external rotation shoulder exercises. However, as the case with hand weights and elastics, pulley machines also store potential energy during use which can result in the aforementioned injuries. Such machines also require a change in user position and/or machine configuration in order to perform both internal and external rotation exercises.

U.S. Pat. No. 4,878,663 discloses a rehabilitation and fitness apparatus which incorporates a range limiter disc. The disclosed device utilizes a rotating disc which is rotated through the action of an actuator bar. However, rather than using the range limiter disc to control the range of movement a user's shoulder could internally or externally rotate, the disclosed device uses the disc to set the actuator bar in a desired "start" position so as to enable one machine to be utilized to perform multiple exercises (such as internal and external shoulder rotation). The disclosed device utilizes a stack of weights to provide resistance to a user's motion which, of course, does entail the storing of potential energy and generation of momentum that can cause the aforementioned problems. The device does provide adjustment of resistance by the use of a pin to control the number of weights in the stack utilized.

U.S. Pat. No. 4,957,281 discloses a rotator cuff therapeutic exercise device which includes a stack of weights supported by a frame which are raised in a working stroke from a rest position, against gravitational force, to a raised position (with stored potential energy). An actuator mechanism on the frame is specifically shaped and configured to be gripped and rotated by the hand of a user to move the weights along the working stroke. The actuator mechanism may be adjusted to a first or second position for enabling a corresponding rotational working motion of the one of the user's arms whose hand grips the actuator mechanism. This device, as discussed above in regard to free weight exercise and elastic resistance machines, stores potential energy and develops considerable momentum which may be damaging to a user and includes no means of controlling the range of motion during inward or outward rotation. The machine also requires manual adjustment to change resistance.

U.S. Pat. No. 5,080,350 discloses a rehabilitation/exercise device wherein elevational adjustment is provided. However, the device disclosed in this patent provides no means to provide limitation to internal or external rotation of a shoulder. The subject device utilizes a brake and brake drum to provide resistance.

Ideally, a shoulder rehabilitation/exercise device should: a. enable an individual to perform internal and external rotations of the shoulder wherein the device: b. enable performance of inward and outward rotations of both the right and left shoulders without having to adjust the device or re-position the user; c. provide secure, stable, and adjustable positioning of a user's elbow; d. provide adjustment to accommodate arm's of varying length; e. provide adjustment of the angle formed between the upper and lower arm; f. provides a means of controlling the range of motion a user may operate the device during such operation; g. provide fluid-like resistance during exercise so as to prevent injury to the shoulder joint; h. exerts no substantial force which would otherwise continue movement of the device after a user has terminated operation thereof; i. enable adjustment of device resistance without having to manually adjust the device; and j. enable manual adjustment in regard to device resistance when such is advantageous.

SUMMARY OF THE INVENTION

Now, in accordance with the present invention, a highly portable shoulder rehabilitation and exercise device is disclosed. The device requires no external source of power and is operated by the physical effort of a user alone. Operation of the device enables a user to accomplish both internal (inward) and external (outward) rotations of both the right and left shoulder joint—without having to adjust the device or the user's position—while providing smooth, fluid-like operation. The device of the present invention enables a user to suddenly terminate such rotation without potential energy or momentum generated by the device being sufficient enough to oppose such termination. The device of the present invention also provides secure, stable retention of a user's elbow while also providing adjustment to accommodate arms of varying dimensions and enabling setting forth a desired angular relation between a user's upper and lower arm. The device of the present invention also enables positive limitation of the range of inward and outward rotation of a user's shoulder during use of the device. Also, the device enables smooth, fluid-like resistance to internal or external rotation which is automatically increased as a user applies greater force to internal and external rotations. In certain preferred embodiments of the present invention, the device includes a means to manually vary resistance to internal and external rotation while also automatically adjusting resistance in accordance with the force applied by a user.

In the first preferred embodiment of the present invention, a shoulder rehabilitation and exercise device is disclosed comprised of a base plate, a hydraulic damper, a transfer arm, an actuator arm, an elbow cup and a hand grip.

The base plate is configured as a substantially flat plate having an upper surface and a lower surface which form flat planes which are parallel to one another. The base plate is provided with a plurality of bores therethrough. The bores include a central axle bore which passes through both the upper and lower surface of the plate especially configured and shaped for passage of the central axle of the damper, discussed below. In addition, the base plate includes restrictor bores especially shaped and configured for the receipt and retention of restrictor pins also discussed in more detail, below.

The base plate includes a means for the stabilization and affixation of the device to a stable surface. For example, the base plate, in certain preferred embodiments, includes a plurality of screw clamp devices extending downward from, and positioned perpendicular to the lower surface of the base plate. Such clamps are utilized to stabilize and mount the device to a flat stable surface such as, for example, a table. For this purpose, it is preferred that at least two such clamp devices are provided. It is still further preferred that three or more such clamps are provided. When, as described below, certain preferred embodiments of the device are configured for mounting the device to the corner of the table top, it is even further preferred that four such screw clamps are provided. In such embodiments, each screw clamp is affixed to the lower surface of the base plate within further bores especially configured to receive same. The bores may be threaded to engage a matingly threaded distal portion of a stud member of a screw clamp. However, the bore may be smooth for receipt of a pressed-in stud. A sliding clamp may be advantageously mounted upon the stud and held upon the stud by a nut such as, for example, a wing nut. Rotation of the wingnut along the stud adjusts the sliding clamp upward (towards the base plate so as to mount the plate to an intervening mounting surface) or downward (so as to release the device from a mounting surface.) In addition to the aforementioned integral screw clamp stabilization means, the present invention also contemplates the use of ordinary external screw clamps to stabilize the device to stable surfaces such as, for example, table tops, chairs and door frames.

In alternate preferred embodiments of the present invention, the base plate may also utilize weights, or be formed of higher weight materials as a means for stabilizing the device during use. In such embodiments, it is preferable to utilize a base plate having an adherent lower surface so that the effect of the weight in combination with the adherent lower surface acts to stabilize the device. For example, the lower surface of the device may be covered with a rubber material such as, for example, a nitrile rubber, a natural rubber, a polythioether rubber or a silicon rubber. Covering or forming the lower surface of the device with such high friction compositions and materials tends to increase the coefficient of friction between the lower surface of the device and, for example, a table top upon which the device might be placed. The increased friction of such a lower base plate surface in combination with the use of a weighted base provides a means of temporarily stabilizing the device for use. Straps, including those utilizing hook and loop fasteners may also be utilized to temporarily position the device to a stable object for use thereof. Hook and loop fastening material may also be applied to the lower surface of the base plate with a mating hook and loop fastening material applied to a table, desk, chair or doorway to provide temporary mounting of the device. Bores penetrating the upper and lower surfaces of the base plate may also be utilized to receive bolts, screws and other like fasteners for more permanent mounting of the device to, for example, a table, chair, desk or doorway.

The hydraulic damper of the present invention provides the above and below described smooth, fluid-like resistance to arcuate movement of the actuating arm while enabling the device to stop immediately in reaction to a user's cessation of application of force to the device. The hydraulic damper is mounted to the lower surface of the base plate and includes a central axle having a proximal terminus, a distal terminus and a longitudinal axis. In preferred embodiments of the present invention, the central axle is oriented and positioned so that the longitudinal axis thereof is perpendicular to the horizontal planes formed by the upper and lower surfaces of the base plate. The term "fluid-like resistance" as utilized herein, refers to the smooth, continuous and evenly applied resistance generated by the device of the present invention and applied in opposition to a user's efforts to bias the restrictor arm in the above-described arc-like motion during use of the device. Thus, the rehabilitation and exercise device of the present invention provides smooth, even and continuous resistance during use, but, at the same time, increase and decreases such resistance in response to a user's acceleration or deceleration of device operation, respectively. Such fluid like resistance is delivered as an even and continuous opposing force void of any pulsatile nature. In addition, such resistance generated by the device terminates upon cessation of application of force to the device by a user.

In certain preferred embodiments of the present invention, the hydraulic damper is a rotary vane displacement damper that enables both clockwise and counterclockwise rotation which is transferred to the restrictor arm via the central axle. It is preferred that such dampers provide at least 90 degrees of clockwise and 90 degrees of counterclockwise rotation so as to provide a total, at a minimum of 180 degrees of rotation.

In preferred embodiments of the present invention, the rotary damper includes a mounting plate, a main housing with a fin(s0 extending radially and inward therefrom, a central axle upon which a rotor is mounted and hydraulic fluid. In preferred embodiments of the present invention, the hydraulic damper is mounted upon the lower surface of the base plate via a damper mounting plate via associated bolts or any other reliable means such as, for example, rivets, screws or bonding. The hydraulic damper is mounted and positioned upon the base plate so that the central axle of the damper extends through the upper surface of the base plate perpendicular to the horizontal planes formed by the planar surfaces of the base.

In certain preferred embodiments of the present invention, the damper includes a manually adjustable hydraulic fluid flow valve which can be operated by a user in order to select a higher or lower range of damper resistance. That is to say, the damper utilized in all embodiments of the present invention provides—automatically—an increase in resistance to arcuate motion of the restrictor arm in response to increased application of force—and thus an increase in acceleration—applied to the hand grip of the actuator arm by a user. Conversely, the damper utilized in all embodiments of the present invention provides a decrease in resistance in response to a decreased application of force—and thus a decrease in restrictor arm acceleration—applied to the hand grip by a user. The resistance of such dampers, from the lowest to highest responsive resistance defines a range of resistance. Embodiments of the present invention which utilize a damper having an adjustable hydraulic valve which is operable by a user (as described below) enables an increase or decrease in the range of automatic resistance provided by the damper.

In embodiments of the present invention utilizing rotary dampers, controlled clearances between a vane(s) extending from the rotating rotor and radially disposed vanes extending inward from the housing causes—upon rotation of the rotor—controlled flow of hydraulic fluid therebetween. The controlled flow created by these fins limits the speed of displacement of hydraulic fluid from one side of the rotor fin(s) to the other when the shaft upon which the rotor is mounted is rotated. Thus, such controlled flow provides the damping function of the dashpot.

In certain preferred embodiments of the present invention, in addition to such controlled clearances, a hydraulic flow valve—or, as it may also be referred to as—an adjuster—provides further control of the displacement of hydraulic fluid caused by the turning of the rotor. Such valves may effectively increase and effectively decrease the restrictive effect of the damper vanes to fluid flow (and thus shaft rotation) by providing the hydraulic fluid contained within the damper with a further pathway or, in some embodiments, control of existing fluid pathways. Such valves may, for example, provide an aperture through which hydraulic fluid, acted upon by the vane of a rotating rotor, may flow. The apertures of these valves—in embodiments of the present invention providing adjustable resistance—may be increased or decreased so as to reduce or increase the force required to force fluid therethrough respectively. For this purpose, such embodiments may, for example, utilize an adjustment pinion which, in turn, is operated by a resistance adjustment wheel to enable a user to manually operate the valve in regard to control the aperture.

As discussed in detail, below, the restrictor and actuator arms rotate upon the central axle of the damper—which extends superior to and is the distal extension of the rotor shaft. Decreasing the hydraulic fluid flow valve aperture will cause an increase in the resistance provided by the damper to these arms which will, in turn, oppose inward and outward rotation of the actuator arm. Simply put, and as is well known to the art of hydraulic dynamics, more force is necessary to cause the same volume of hydraulic fluid through a smaller aperture at a given time period. Conversely, increasing the aperture will decrease resistance to rotation.

It is preferred that the hydraulic damper utilized in preferred embodiments of the present invention generate a rotational resistance from about 0.5 to about 80 Nm/radian/s. It is still further preferred that the damper generate a rotational resistance of from about 2 to about 40 Nm/radian/s. Such resistance enables a user to gently perform internal and external rotations with diminimus resistance while increasing flexibility and range of motion. At the same time, the higher end of this range of resistance enables a user to apply greater biasing force—lateral force applied to the device through the handgrip which causes the actuator arm to follow internal and external arcuate movement—so as to thoroughly work and strengthen the associated muscles.

A hydraulic damper, well suited for use in the present invention is the model LA Dashpot manufactured by Kinetrol, LTD, Trading Estate, Surrey, England GUN 9NU. This hydraulic damper is a vane displacement unit wherein a vane on the shaft rotates past fixed vanes on the body of the unit. This damper provides 215 degrees of rotation. It is preferred that any rotary damper utilized in practicing the present invention demonstrate, at minimum, 180 degrees of rotation.

The restrictor arm of the present invention is configured, in certain preferred embodiments, as an elongated bar having a proximal terminus, a distal terminus, a longitudinal axis extending therebetween, an upper surface, a lower surface and two side surfaces. The restrictor arm is mounted, (at the lower surface thereof) upon the central axle of the hydraulic damper. The mounting of the transfer arm upon the central axle of the rotary hydraulic damper provides, in essence, a pivoting axis formed about the longitudinal axis of the central axle. In operation of the device, discussed in more detail, below, the transfer arm moves along an arcuate path which is parallel and superior to the horizontal plane formed by the upper surface of the base plate. Such movement occurs when torsional force—a lateral biasing force causing internal and external rotation of the actuator arm—is applied to the transfer arm via a user's application of such force to the hand grip of the actuator arm.

In preferred embodiments of the present invention, the proximal terminus of the restrictor arm is continuous with and terminates in a restriction finger. In such embodiments of the present invention, the restrictor arm is so named due to the ROM (Range of Motion) functions discussed immediately below. The restriction finger is a proximal extension of the restrictor arm especially shaped and configured to engage, along the arm's arcuate path, restrictor pins which limit the arc through which the restrictor arm, and thus activator arm to which it is affixed, may travel.

More specifically, in certain preferred embodiments of the present invention, restrictor pin bores are prepared in an arcuate pattern within the upper surface of the base plate corresponding to an arc traversed by the restriction finger during device operation (rotation of the arm upon the central axle of the hydraulic damper). For example, the restrictor pin bores may be placed along the aforementioned arc at 30 degree intervals with a 0 degree bore being aligned with the restriction finger when the restrictor arm is in a neutral (0 degree position) which corresponds to the position of the device when the longitudinal axis of the restrictor arm is located at the center of the inward and outward arc movements produced thereby. More specifically, the device of the present invention is capable of rotating outward and inward to provide corresponding external and internal rotation of the shoulder. At a neutral or "0" position, the device is aligned at the intersection of outward and inward movements and is also aligned with the longitudinal axis of the base plate. From this neutral position, the device may be operated so as to perform internal and external rotations of the shoulder by laterally biasing the actuator arm inward and/or outward, as explained in more detail, below. In certain preferred embodiments of the present invention, the degree to which the device may be utilized to move inward or outward from the neutral position can be controlled by placing restriction pins within the restriction bores located, for example, at 30 degree intervals from 0 to 90 degrees inward rotation and 0 to 90 degrees outward rotation. Therefore, the upper surface of the base plate will include, from the rearmost portion thereof, a 0 degree bore followed by a 30, 60 and 90 degree bore—on either side of the 0 degree (neutral) position of the restrictor finger. Placement of restrictor pins in such bores is advantageously utilized to control and limit the degree of rotation of the restrictor arm as well as the actuator arm to which it is attached and which is engaged by a user during device operation. Thus, for example, the device may be set to allow inward (or internal) rotation of 60 degrees while limiting outer (or external) rotation to 30 degrees. Although the foregoing example utilizes 30 degree increments and 90 degree endpoints, the present invention is not limited to such increments and contemplates the placement of restriction pin bores in any pattern or increment found useful for therapy.

The actuator arm of preferred embodiments of the present invention is advantageously configured as an elongated bar having a proximal terminus, a distal terminus, a longitudinal axis extending therebetween, an upper surface, a lower surface and two side surfaces. A hand grip and an elbow cup, described in greater detail below, are adjustably mounted upon and extend upward from the upper surface of the actuator arm.

The actuator arm, at an area adjacent to the proximal terminus thereof, is affixed to the restrictor arm at a position adjacent to restrictor arm's distal terminus. Therefore, the fixation of the actuator arm to the restrictor arm results in transmission of torsional force from the actuator arm to the restrictor arm. More specifically, torsional force applied to the actuator arm thus causes the actuator arm and restrictor arm to which it is affixed to move in an arcuate path about the axis formed by the central axle of the hydraulic damper. (In operating the device, as described in more detail, below, a user utilizes the hand grip of the device to apply inward or outward lateral force to the actuating arm while the associated elbow is stabilized within the elbow cup.) It is preferred that the restrictor arm be affixed to the actuator arm in such a manner and by such means as to create a pivoting attachment therebetween. More specifically, it is preferred that the actuator arm is pivotally affixed to the restrictor arm so that the elevation of the actuator arm may be adjusted from a neutral position, parallel to the planar surfaces of the base plate, to a desired elevated position of, for example, from 0 to 45 degrees.

In certain preferred embodiments of the present invention, side plates are provided as a means of affixing the actuator arm to the restrictor arm. The side plates may be configured, for example, as flat elongated plates having two broad planar surfaces, an upper edge, a lower edge, a proximal terminus and a distal terminus. The side plates advantageously include a plurality of bores penetrating through the two broad planar side surfaces which are especially shaped and configured to enable alignment thereof with portions of the side surfaces of the actuator arm and the restrictor arm which include corresponding bores or other means, such as, for example, threaded receiving nuts, for affixation of the side plates to the actuator arm.

A distal portion of each side plates may, for example, be affixed to a corresponding side surfaces of the actuator arm along a proximal portion thereof utilizing assembly bolts which pass through bores located along the overlying portion of the side plates and engage, for example, assembly bores located along the proximal portion of the two sides of the actuator arm. Alternatively, assembly plates having threaded bores therewithin may be positioned within channels formed in the side walls of the actuator arm. In such embodiments, assembly bolts which pass through the bores formed in the side plates are aligned with and matingly engage threaded bores within the assembly plates so as to affix both the side plates and the assembly plates to the actuator arm. The proximal portion of the side plates may then be joined to the restrictor arm upon the two side surfaces thereof along the distal portion of the restrictor arm in a like manner. However, as discussed above, it is preferred that the actuator arm and restrictor arm are joined via a pivoting joint enabling adjustment of elevation of the actuator arm. In such embodiments, the restrictor arm advantageously includes a pivot bore running through both side surfaces of the restrictor arm adjacent to the distal terminus thereof. The proximal portion of the two side plates includes corresponding bores that align with the pivot bore of the restrictor arm so that a pivot bolt may be pass through one plate, through the sides of the restrictor arm via the pivot bore and then through the second plate. The pivot bolt may be secured in such position via a washer and nut. Use of a pivot bolt to provide fixation of the actuator arm to the restrictor arm enables the actuator arm to pivot upward so that, as described in more detail above and below, the angle between the restrictor arm and actuator arm—and thus a user's forearm and upper arm—can be altered when utilizing the device. Thus, embodiments of the present invention that utilize a pivot bolt to affix the restrictor arm to the actuator arm provide the added utility of elevation adjustment. The present invention also contemplates embodiments wherein the pivot bore is located near the proximal terminus of the actuator arm.

In certain preferred embodiments of the present invention utilizing a pivot bolt for elevation adjustment, the side plates additionally include, distal to the pivot bore, an elevation lock bore passing therethrough. The elevation lock bore is a hole especially configured and adapted to receive an elevation lock pin. The elevation lock bore is also especially configured, positioned and prepared to align with a plurality of elevation adjustment bores. The elevation adjustment bores comprise holes prepared through and penetrating the sides of the restrictor arm and which are located proximal to the pivot bolt bore. The elevation adjustment bores are prepared so as to align with the elevation lock bore at various positions which correspond with selected elevations of the actuator arm (in relation to the restrictor arm). For example, the elevation adjustment bores may be situated to provide the actuator arm with an elevation of 0 degrees, 22 degrees and 45 degrees. Aligning the elevation lock bore prepared in both sides of the restrictor arm with a selected elevation adjustment bore—and then passing a elevation lock pin through the lock and elevation adjustment bores will thus position and retain the actuator arm in a selected elevation. Selecting, for example, the 0 degree elevation adjustment bore for pin engagement will set the actuator arm in horizontal alignment with the base plate and restrictor arm. Conversely, selecting the 45 degree bore and thereafter aligning and locking the actuator arm in that position, will cause the actuator arm to be elevated upward at 45 degrees relative to the horizontal plane. Use of the locking pins further stabilizes a selected elevation attained via operation of the pivot bolt and includes the further advantage of enabling selection of a fixed elevation.

As discussed above and below, when the device is utilized, a user's elbow lies in an elbow cup and a user's hand grasps a handgrip both of which are mounted upon and extend upward from the upper surface of the actuator arm. With a user grasping the device in this manner, changes in actuator arm elevation cause the angle of the user's forearm and upper arm to change. Elevation adjustments enable a user to set the angle between the upper and lower arm at a desired position or a position as instructed by a therapist. Furthermore, as elevation is increased, the effective radius of the lever arm running from the central axle of the damper to the hand grip decreases thereby producing an increase in effort in operation of the device.

The elbow cup of the present invention is especially configured and adapted for comfortable and secure placement of a user's elbow therewithin. Likewise, the handgrip is adapted and configured for secure grasping by a user's hand. The handgrip is affixed and positioned along said actuator arm distal to the position of the elbow cup. The present invention utilizes adjustable mounting for both the elbow cup and hand grip. Thus, the upper surface of the actuator arm may be configured (as described below) to include an adjustment channel along which both the hand grip and elbow cup may be moved. Any adjustable fastener such as, for example, a nut and bolt (with washer) may be utilized to affix the hand grip and elbow cup at a desired position within the channel. Ordinarily, the elbow cup is positioned so that an elbow placed therein lies over the axis of arcuate motion (and the central axle that forms this axis). Although, in most instances, the elbow cup will remain aligned with the rotational axis, special circumstances including, but not limited to special therapeutic needs and unusual physical dimensions may require some adjustment of the position of the elbow cup. Due to varying user physical dimensions, the distance between the user's elbow and hand is accurately accommodated by adjusting the position of the handgrip.

When utilizing the shoulder therapeutic and exercise device of the present invention, the device must first be stabilized against movement of the base plate. For this purpose embodiments of the present invention utilizing the screw clamp fixation means discussed above and below may be affixed to, for example, the corner of a table. Once the device is so stabilized, a user positions the elbow corresponding to the shoulder to be exercised within the elbow cup. As discussed above, the elbow cup is ordinarily located so as to place the user's elbow directly above the central axle (and thus at the axis of rotation). However, it certain instances, and depending upon therapeutic needs of the individual, some proximal distal adjustment of the elbow cup may be required. For example, if the height of the surface to which the device is mounted, or the height of the chair a user is such that there is insufficient distance between the user's shoulder and the elbow cup to enable the user's shoulder to be directly over the user's elbow, the elbow cup may be moved distally in order to obtain a more favorable relationship between shoulder and elbow. Once the position of the elbow cup is fixed, the hand grip position is adjusted so that, while the users elbow is comfortably situated within the elbow cup, his hand may easily grip the hand grip while the forearm overlies the longitudinal axis of the actuator arm so as to achieve a proper hand grip position. Once the proper hand grip position is achieved, embodiments of the present invention including a restrictor arm (with restrictor finger, restrictor bores and restrictor pins) may be adjusted to provide a desired ROM (range of motion) for internal and external rotation of the shoulder. Restrictor pins provide a positive stop which physically prevents a user from surpassing the set ROM. As described above, for this purpose, restrictor pins are placed in restrictor bores corresponding to the desired maximum degree of external and internal rotation. Placement of the restrictor pins within the restrictor bores located along the arcuate path of the restriction finger therefore prevents a user from exceeding the ROM limits defined and set thereby.

In embodiments of the present invention which feature elevation adjustment of the actuator arm, the elevation of the actuator arm is set by selecting a desired elevation. This may be accomplished by simply loosening the pivot bolt, raising the actuator arm to a desired angle of elevation, and thereafter tightening the bolt. However, in preferred embodiments of the present invention, the restrictor arm includes the above and below described elevation adjustment bores, the actuator arm includes an elevation lock bore, and an elevation lock pin is utilized to set the actuator at a selected angle of elevation. In such embodiments, each of the elevation adjustment bores located upon and passing through the sides of the restrictor arm may advantageously include an elevation number adjacent corresponding to the degrees of elevation (starting from a horizontal position parallel to the base plate of 0 degrees). Therefore, a user simply aligns the elevation lock bore of the side plates with a selected and labeled elevation adjustment bore within the restrictor bar and thereafter slides the elevation lock pin therethrough. The elevation pin then retains the actuator arm at the selected elevation.

After the device has been adjusted as described above, the user may then inwardly and outwardly rotate the actuator arm by applying a corresponding inward and outward lateral force thereto via the handgrip. A user may increase the resistance (and thus exercise difficulty) provided by the device to such motion by simply increasing the force he or she applies to the actuator arm via the hand grip. The increased force tends to cause the arcuate motion of the actuator and restrictor arm to accelerate. This acceleration in movement is transferred to the hydraulic damper via the central axis. More specifically, increased speed of rotation of the central damper necessarily causes an increase in rotation of the central axle which, in turn, cause an increase in the velocity of hydraulic fluid propelled by a fluid propulsion means such as, for example, piston(s), vane(s) or fin(s). This increased speed forces an increased volume of fluid through the apertures of a hydraulic fluid flow valve (also referred to herein as hydraulic flow valve and flow valve) The effect of the forcing of the increased volume of fluid through the aperture is, of course, increased resistance to flow and, accordingly, the hydraulic piston(s), vane(s) or fin(s) provide more resistance to the rotation of the central axle which, in turn, is transmits such increased resistance to the restrictor and actuator arm.

In certain preferred embodiments of the present invention, the hydraulic damper includes a resistance adjustment wheel which controls an adjustable hydraulic flow valve. A user may turn the adjustment wheel to a selected position indicated by, for example, a number on the wheel which is aligned with a mark adjacent the damper. Movement of the wheel varies the aperture of an adjustable hydraulic fluid flow valve. More specifically, turning the wheel in one direction has the effect of increasing the aperture of the valve. An increase in flow valve aperture causes, as is well known to the art of hydraulic fluid dynamics, a reduction in resistance to flow. This reduction in flow resistance, in turn, results in a decrease resistance of the hydraulic damper to rotation via inward and outward rotation of the actuator arm. Conversely, turning the resistance adjustment wheel in the other direction has the effect of decreasing the aperture of the hydraulic fluid flow valve, which increases the resistance presented by the valve to hydraulic fluid flow. Such increased valve resistance, in turn, increases the resistance to movement of the damper piston(s), vane(s) or fin(s0 and thus increased resistance presented by the damper to the restrictor and actuator arm via the central axle. Thus, rotation of the resistance adjustment wheel in one direction increases resistance to user inward and outward rotation of the actuator arm while rotation of the resistance adjustment wheel in the opposite direction decreases such resistance. However, regardless of the adjustment wheel setting, increased lateral force applied to the hand grip of the device by a user attempting to perform internal and/or external shoulder rotations will, of course, increase resistance to such movement generated by the hydraulic damper due to well known principles of hydraulic dynamics. Conversely, a user's reduction in force applied to the hand grip will result in a decrease in hydraulic damper resistance to movement.

The device of the present invention is designed and configured to enable a user to utilize the device by placing the forearm corresponding to the shoulder to be exercised upon an actuating arm while the elbow of that same arm is retained in an elbow cup and the associated hand grasps an upright handgrip (described in more detail, below). The device of the present invention allows a user to perform both internal and external rotations of the shoulder joint by rotating the actuating arm in an arcuate pattern which causes a corresponding rotation of the related shoulder. Internal and external rotations of both the right and left shoulders are performed without need to make any adjustment to the device as the arcuate path provided thereby encompasses both motions.

The shoulder rehabilitation and exercise device of the present invention provides resistance against the aforementioned internal and external rotations which is proportionally and automatically increased and decreased in reaction to increasing and decreasing torsional force (respectively) applied to the device by a user. Thus, a user can increase resistance to shoulder rotations by simply applying greater torque to the actuating arm, and thus moving the device with greater speed without the need to make manual weight and/or other resistance adjustments.

All embodiments of the present invention are especially designed, configured and formed to be highly portable exercise/rehabilitation devices. The term "highly portable exercise/rehabilitation device" as utilized throughout this specification and within the claims refers to a device which, due to relatively light weight and ability to be quickly, easily and reversibly affixed to a surface for use, can be easily moved from place to place by one person, with very little effort. In order to achieve such portability, it is preferred that the device of the present invention weigh from about 5 to about 20 pounds and include a quick and simple means for releaseably affixing the device to a surface for use (which such means are described, in detail, both above and below). However, it is preferred that the device of the present invention weigh from about 7½ pounds to about 15 pounds. It is still further preferred that the device weigh between 8 and 12 pounds. The aforementioned weights and means of reversible affixation enable to the device to be easily transported from place to place as well as enabling such devices to be easily moved from storage to a point of use without requiring great effort, complicated tools, or additional personnel necessary to transport therapeutic devices of greater weight and requiring permanent mounting. The term "reversible affixation" as utilized within the specification and throughout the claims refers to a means which enables the device of the present invention to be stabilized to a surface, and then, if desired, quickly and easily removed therefrom for transportation. For example, the clamp means described above, and below, including the integral clamps and separate external clamps, comprise means of reversible affixation.

The rehabilitation and exercise device of the present invention protects a user from deleterious effects of rehabilitation and/or exercise device inertia and stored (potential) energy. More specifically, when a user stops applying force to the actuating arm of the device, the arcuate movement of the arm terminates—without the device resisting termination of movement via application of inertial, kinetic or stored energy that would otherwise have the effect of opposing such termination of movement—. Simply put, upon termination of the application of force by a user, the device of the present invention ceases the above-described arc-like movement so as to protect a user from the action of inertial or the release of stored potential energy that might otherwise cause injury.

DETAILED DESCRIPTION OF THE PREFERRED EMBODIMENT

Figure 1:
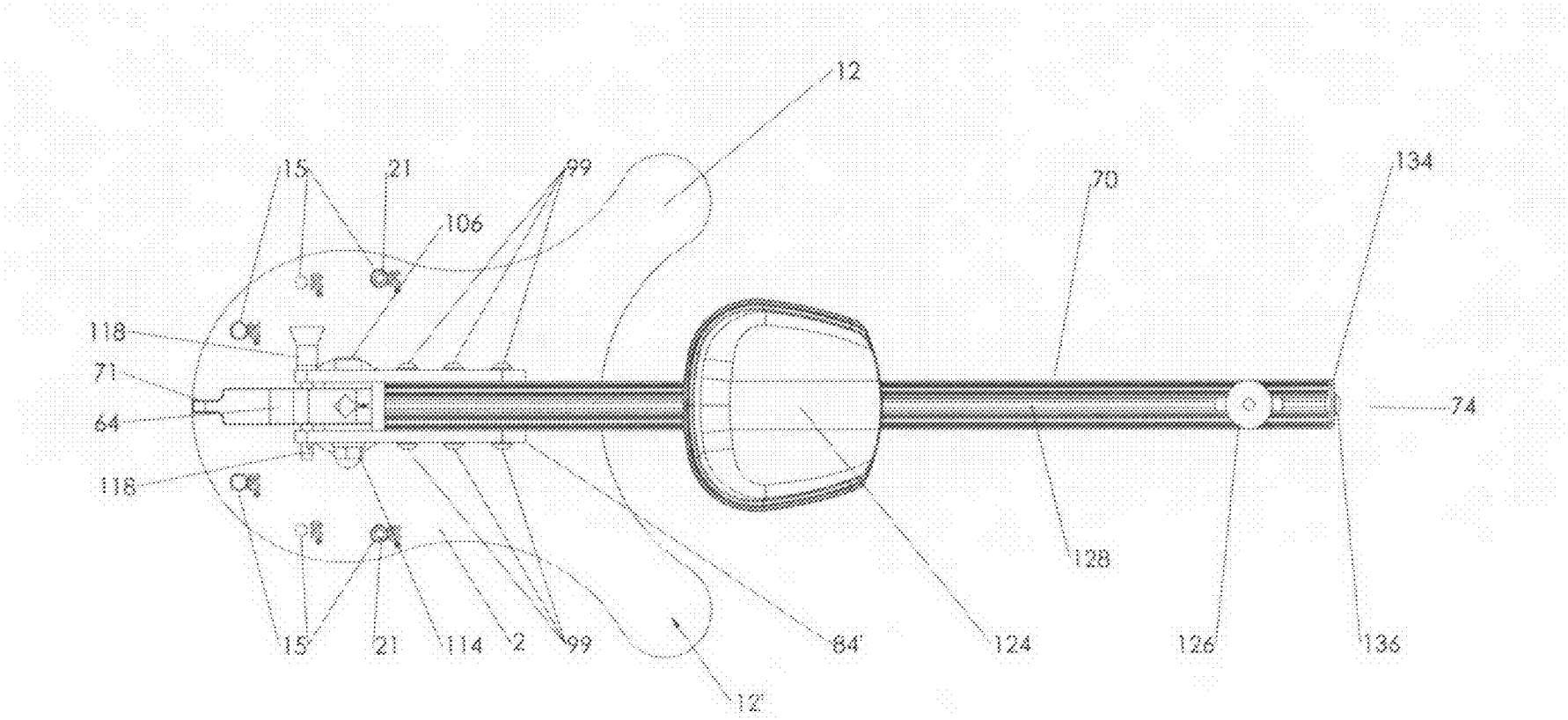
FIG. 1 illustrates a top view of a preferred embodiment of the present invention.
Figure 2:
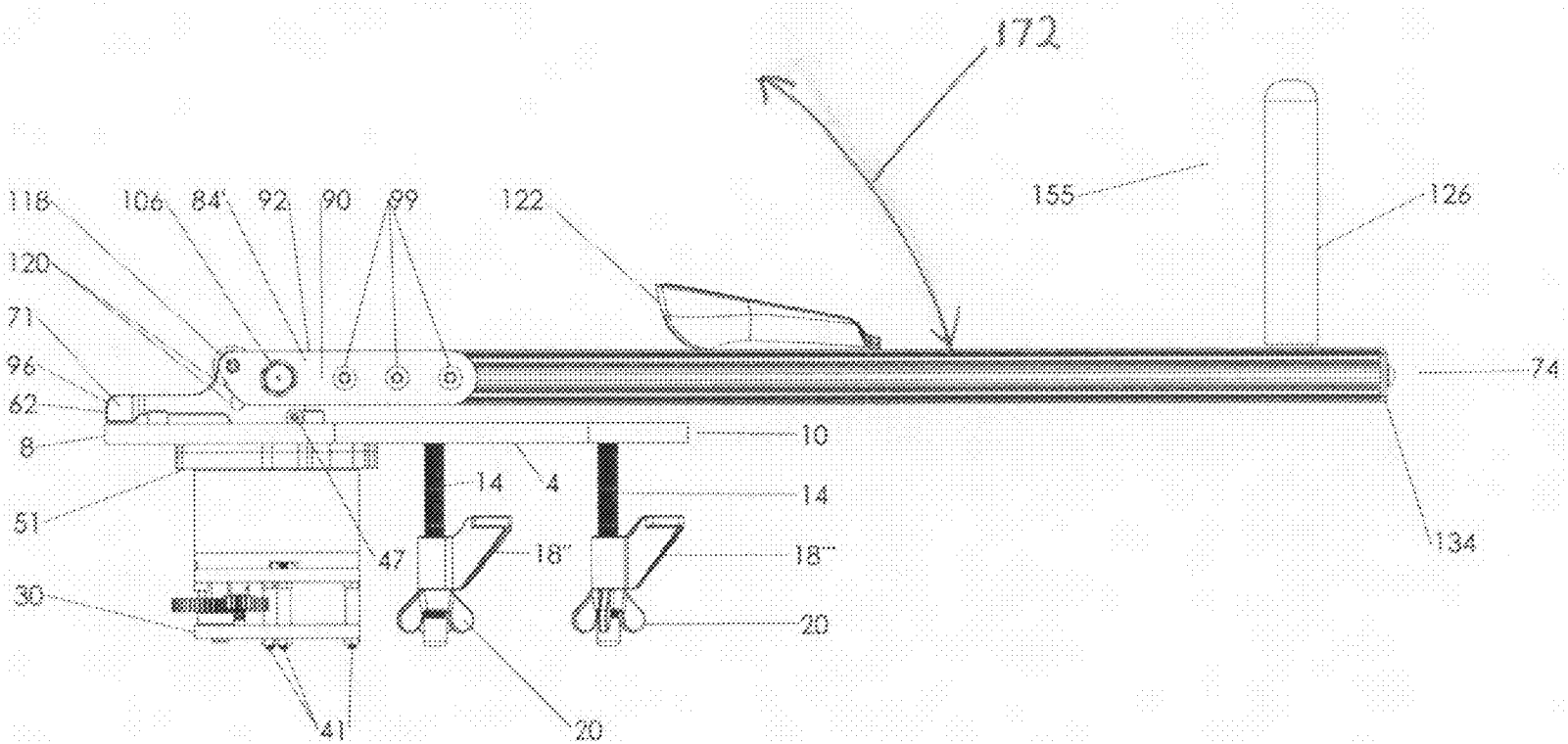
FIG. 2 is a side view of the preferred embodiment illustrated in FIG. 1.
Figure 3:
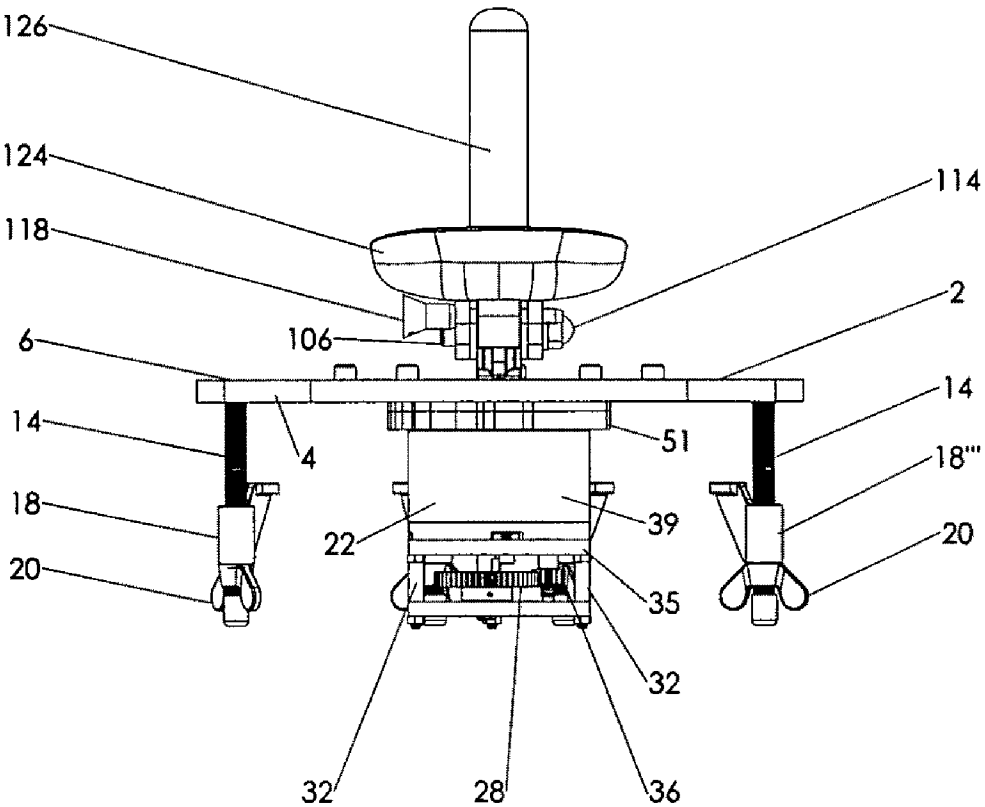
FIG. 3 is a rear view of the preferred embodiment illustrated in FIG. 1.
Figure 4:
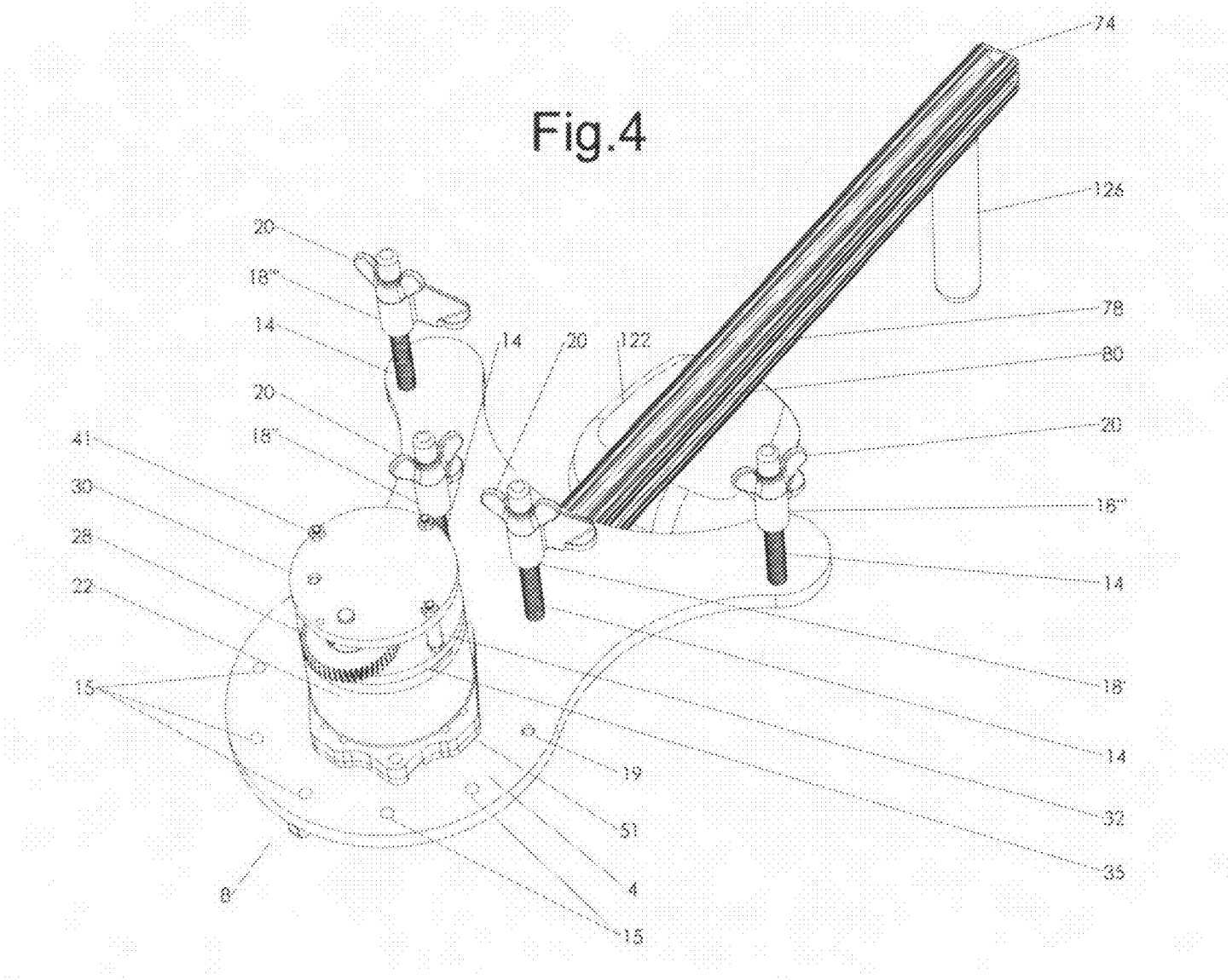
FIG. 4 is a bottom isometric view, from a left aspect, of the preferred embodiment illustrated in FIG. 1.
Figure 5:
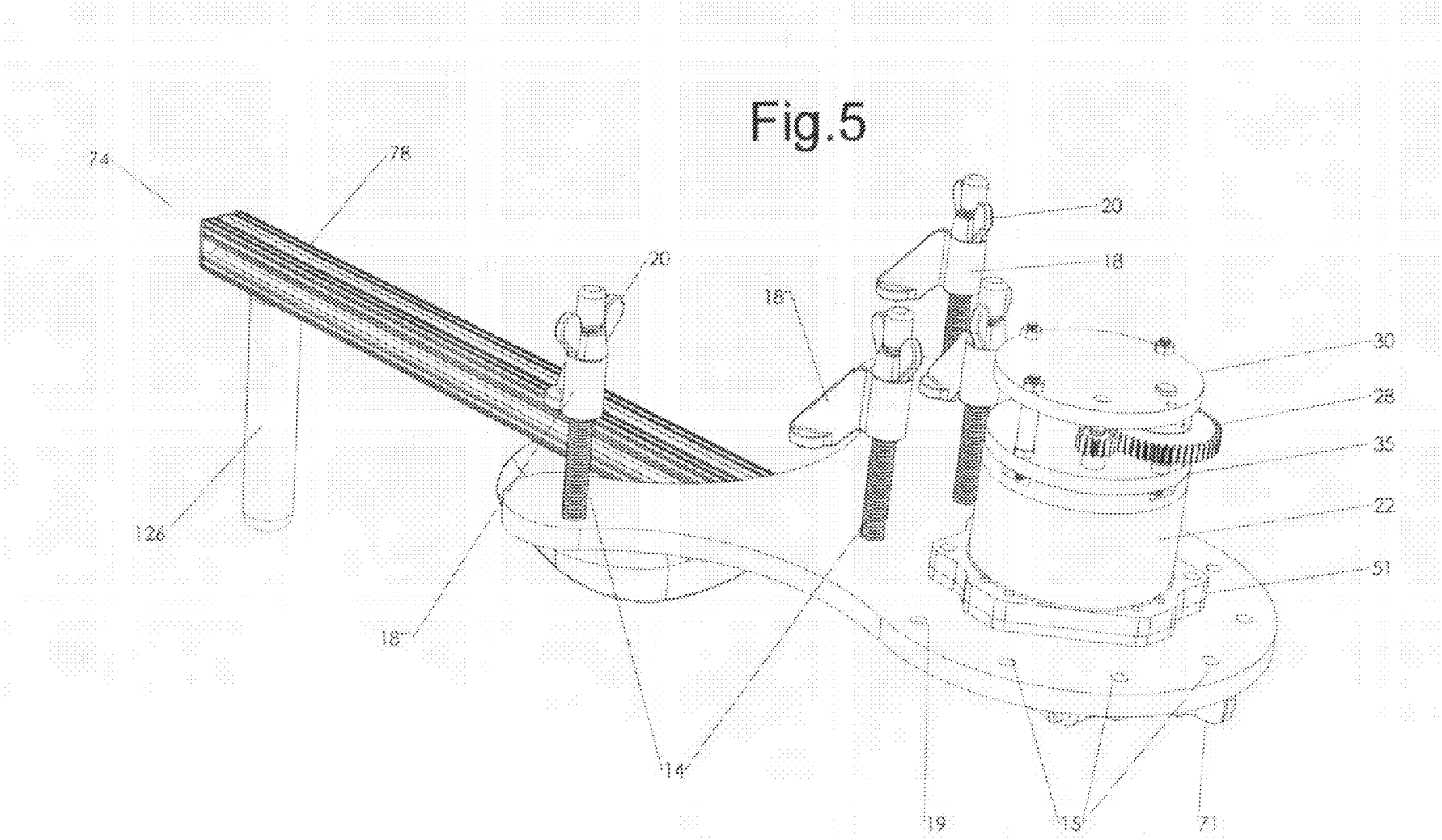
FIG. 5 is an additional bottom, isometric view, from a right aspect, of the preferred embodiment illustrated in FIG. 1.
Figure 6:
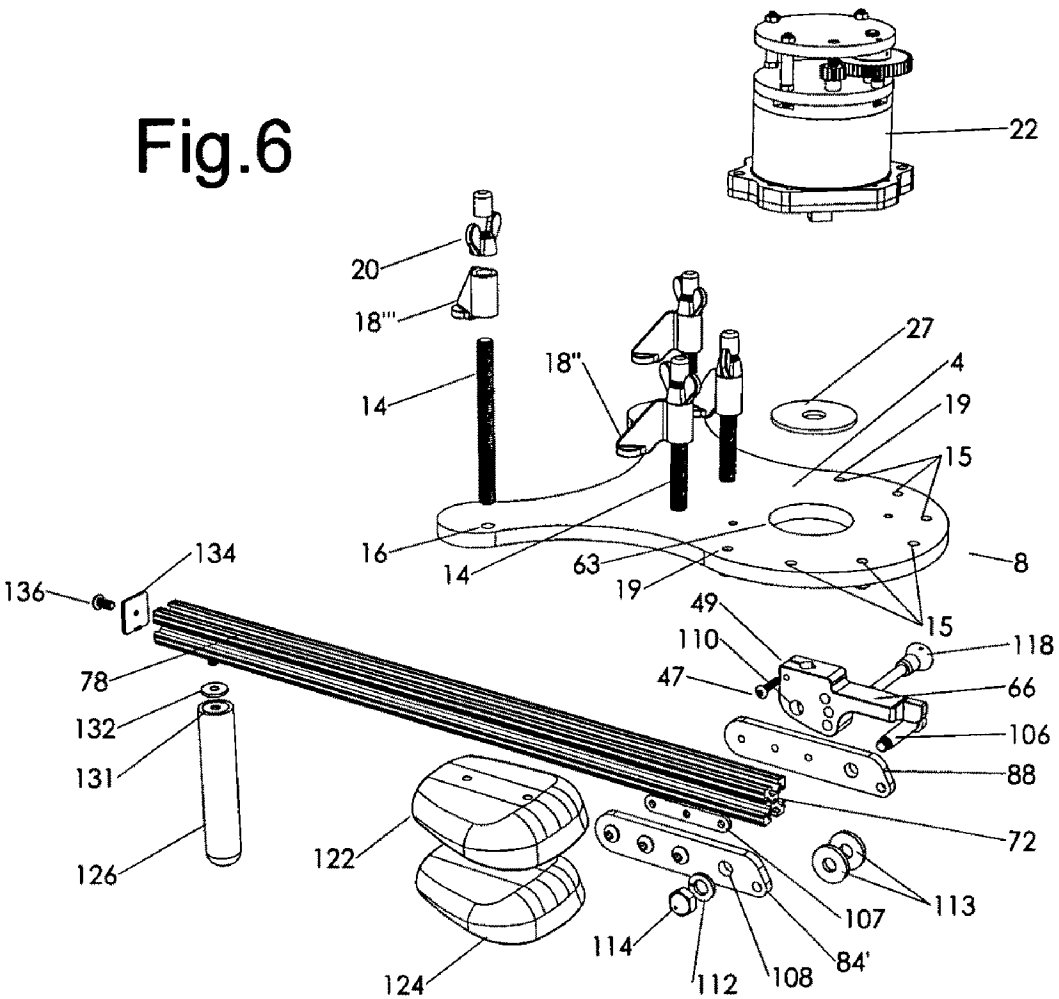
FIG. 6 is a bottom isometric exploded view of the device of the present invention illustrated in FIG. 1.
Figure 7:
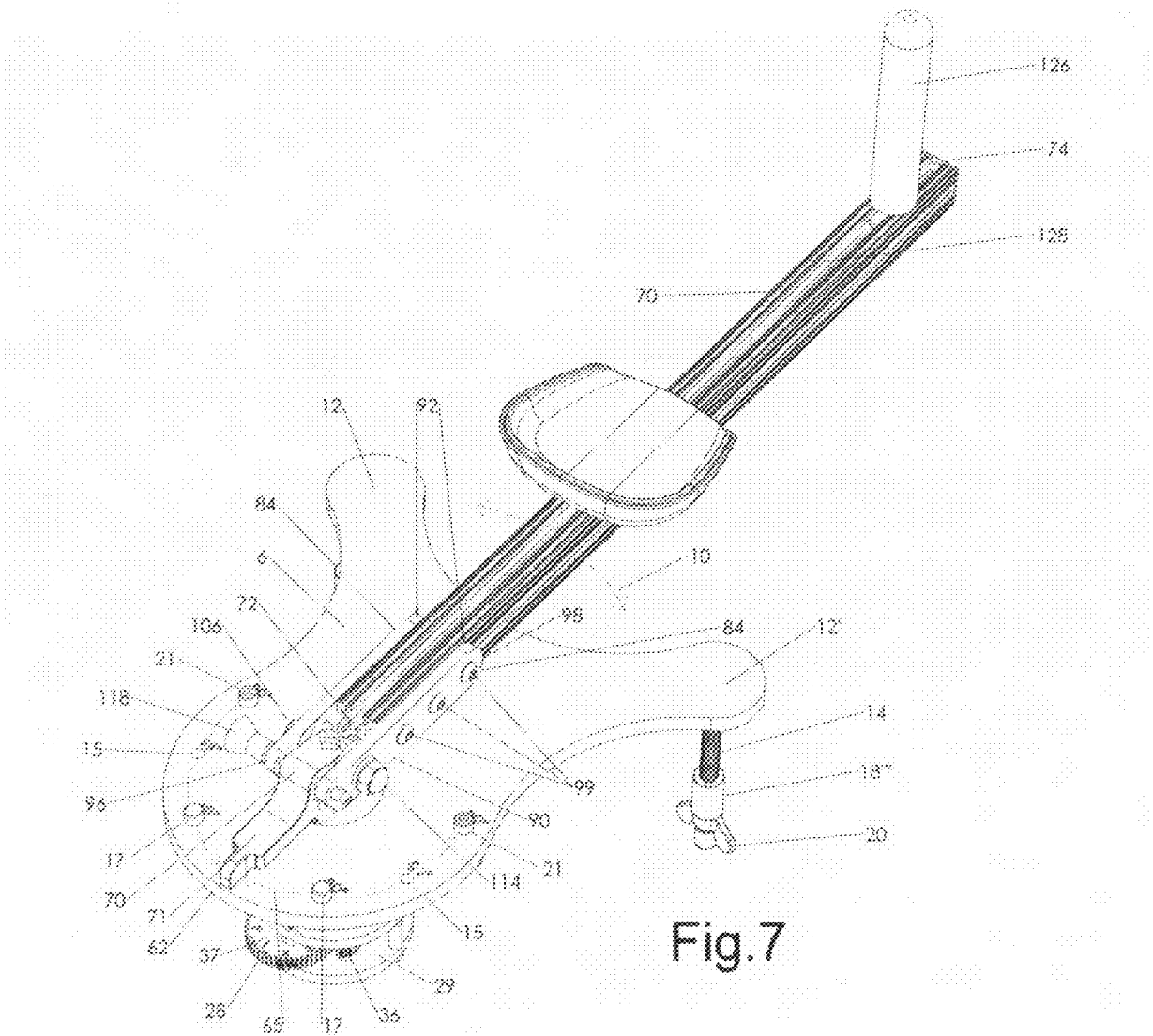
FIG. 7 is top isometric view of the device of the present invention illustrated in FIG. 1.
Figure 8:
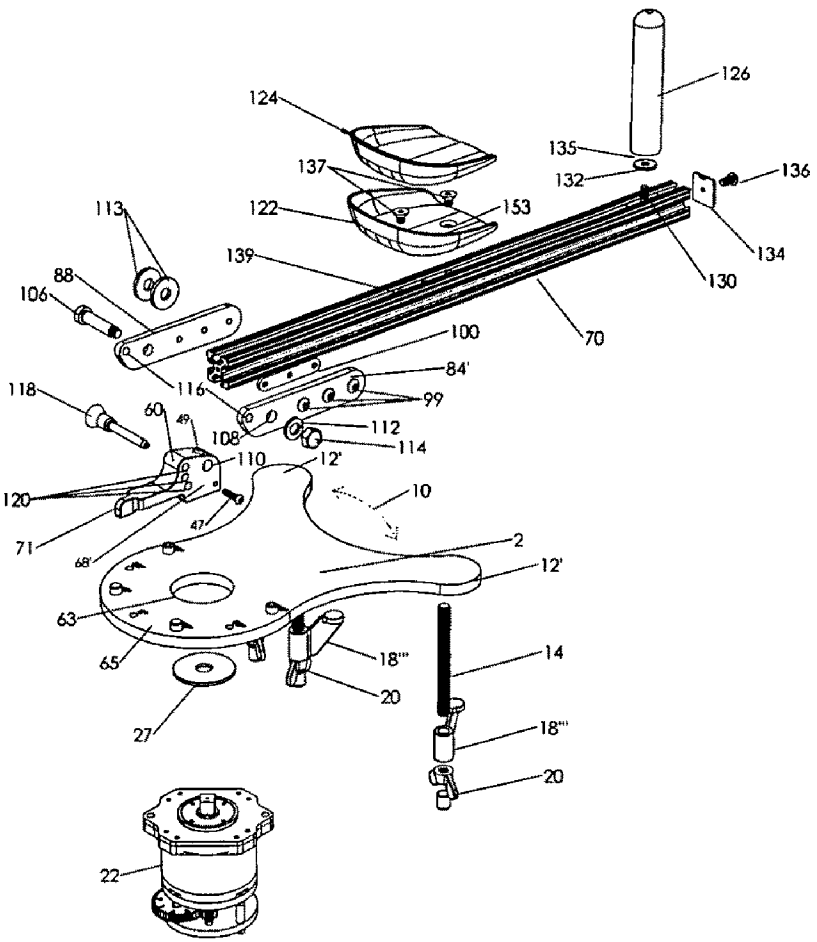
FIG. 8 is a top isometric exploded view of the device of the present invention illustrated in FIG. 1.
Figure 9:
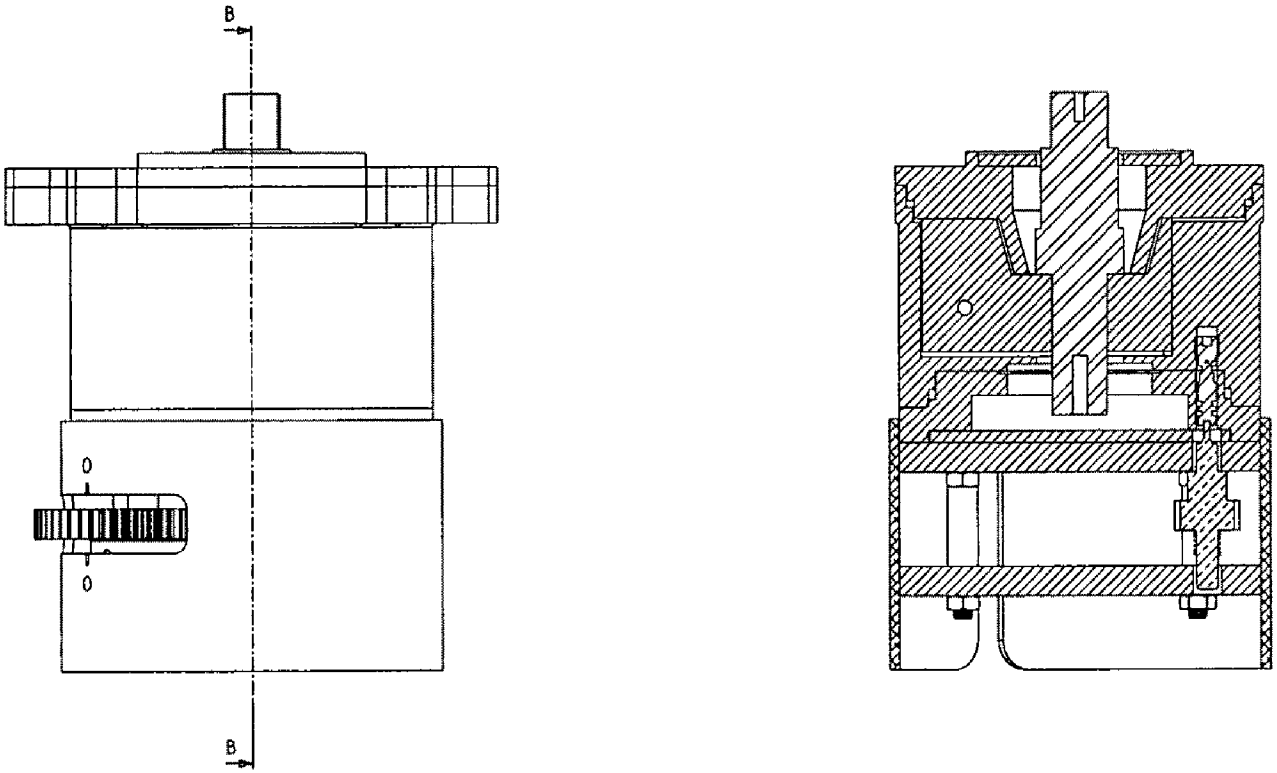
FIG. 9 is a sectional view of the hydraulic damper illustrated in FIG. 1.
Figure 10:
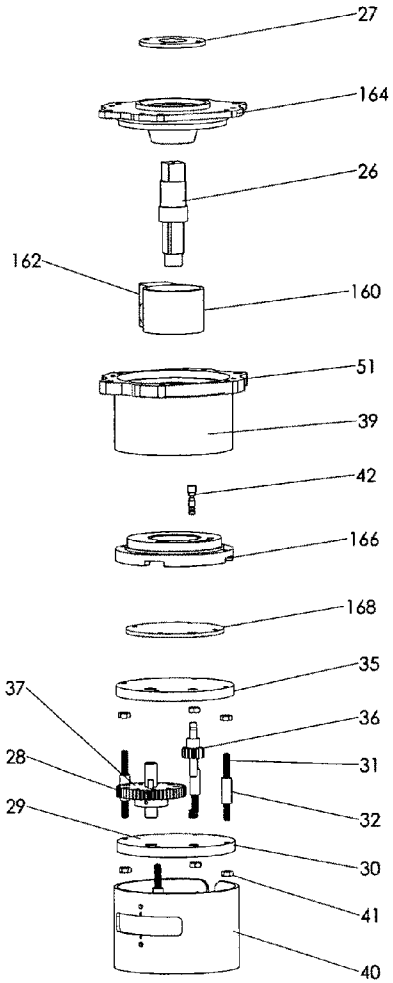
FIG. 10 is an exploded view of the hydraulic damper illustrated in FIG. 9.

The drawing figures (1-8) illustrate a preferred embodiment of the shoulder therapeutic and exercise device of the present invention. FIGS. 9 and 10 illustrate, in detail, the damper shown in the preceding figures.

As illustrated in the figures, base plate 2 is configured as a flat plate having a lower surface 4 and an upper surface 6. The base plate may also be described as having a proximal portion 8 and a distal portion 10 as well as a longitudinal axis running from the proximal to distal portions of the base plate, along the midline thereof. The overall shape of the base plate utilized in the preferred embodiment illustrated in the figures includes two distal extensions 12 & 12'. As discussed in more detail below, these distal extension of the distal portion of the base plate of this particular embodiment of the present invention enable the base plate to easily engage the corner portion of a table top. The base plate illustrated also includes restrictor bores 15, which, as described above and below are utilized to engage restrictor pins 17 which, in turn, restrict the range of motion of the device. The embodiment illustrated in the figures also includes a restrictor screw 21 which threads into a selected restrictor bore—which advantageously includes threads within the baseplate to provide a positive stop which must be unscrewed to be removed and repositioned. In the figures, the restrictor bore and screw are located at the 90 degree position which limits the rotation of the restrictor arm to 90 degree clockwise and 90 degree counterclockwise rotation.

The base plate may be formed of any material demonstrating sufficient strength and rigidity so as to withstand the forces generated during use of the device. For example, the base plate may be formed of a metal such as steel, aluminum or alloys thereof. However, the base plate may also be formed of high strength plastic materials such as, for example composite plastics such as carbon fiber reinforced plastic and fiberglass materials.

The preferred embodiment illustrated in the figures includes the above-described screw clamp means for affixing the device to a table top. More specifically, threaded anchor studs 14 engage and are affixed in anchor stud bores 16. Clamps 18, 18', 18" and 18'" are slideably mounted upon each of the aforementioned threaded studs. Each of the studs is also fitted with a wingnut 20. The base plate of the preferred embodiment is shaped and configured so that the distal portion of the plate, between the to distal extensions 12 and 12', may be placed over the top of a table at a corner location thereof. In orienting the device in this manner, the clamps 18 & 18'" mounted upon the studs extending downward from distal extensions of the base plate, may be oriented so as to engage the underside of a table top, lateral to and on either side of the corner while the two clamps 18' & 18" located further proximal and closer to the longitudinal axis of the base plate lower surface are oriented so as to engage the underside of the table closer to the corner. By tightening each of the wing nuts, the clamps move towards the undersurface of the table top and thereafter engage same while the bottom surface of the base plate is biased against the top surface of the table.

A rotary hydraulic damper 22 is mounted upon the lower surface of the base plate via damper mounting plate 51 and associated bolts. The hydraulic damper is mounted and positioned upon the base plate so that the central axle 26 thereof extends through the upper surface of the base plate along the longitudinal axis thereof. The preferred embodiment of the present invention illustrated in the figures advantageously includes a hydraulic damper which is adjustable in terms of resistance to rotation of the central axle. More specifically, the hydraulic damper includes resistance adjustment wheel 28 which is rotatably mounted upon the upper surface 29 of adjustment plate 30 via studs 31, bushings 32 and nuts 41. Bushings and nuts are utilized to mount the adjustment plate to an intermediary plate 35 which, in turn, is affixed to the main damper housing 39 (along with, in certain preferred embodiments, additional bolts). The adjustment wheel comprises a gear, rotation of which, when the damper is assembled, causes rotation of valve adjustment pinion 36 which is also mounted upon the upper surface of the adjustment plate. More specifically, the adjustment wheel includes numerical indicators such as, for example, engraved or etched numbers running, for example, from 1 to 10, circumferentially along the superior surface 37 of the adjustment wheel. An indicator mark 38 is placed upon the outside surface of adjustment assembly cover 40 (which may also be referred to as the adjustment control housing) so that a user can rotate the adjustment wheel to a desired number setting. Rotation of the wheel, as mentioned above, causes a simultaneous rotation of the adjustment gear pinion which, in turn, operates hydraulic flow valve 42 which restricts the movement of hydraulic fluid caused by motion of the vane 154. In preferred embodiments of the present invention, the adjustment wheel, pinion and valve are configured so that as the wheel is rotated in a direction resulting in higher numbers aligning with the indicator mark, the valve constricts flow of hydraulic fluid during rotation of the central axle. Such constriction results in greater resistance of central axle 26 against rotation—either clockwise or counterclockwise—. Since, as discussed above and below, the restrictor arm is mounted upon the central axle, increasing the numerical position of the adjustment wheel will cause greater resistance to rotation of the device by a user. More specifically, a user who has placed his elbow within the elbow cup lined with the elbow pad and has gripped the handgrip (all with the same arm) will need to utilize more force—at any given speed of operation—in attempting to inwardly or outwardly rotate his shoulder when higher adjustment numbers are selected. However, as also discussed above, regardless of the position of the adjustment wheel, attempting to operate the device with quicker movements will also generate greater resistance while, operating the device more slowly will result in less resistance. Thus, as discussed above, the adjustment wheel enables an increase or decrease in the range of resistance provided by the damper to operation of the actuator arm by a user.

As discussed above, the rotary hydraulic damper includes a rotor 160 upon which a fin 162 (which may also be referred to as a vane) extends. When the rotor turns, in response to turning of the central axle 26 of the damper, the fin causes hydraulic fluid with the damper reservoir to flow therewithin. The reservoir, which is contained within and defined by housing 39, upper seal 164 (with gasket 27) and lower seal 166 (with gasket 168) is filled, for example, with a silicon hydraulic fluid. As discussed above, central axle 26 of the hydraulic damper extends through the base plate (through gasket 27) via axle bore 63 where it enters through the lower surface of the restrictor arm 60, through lock bore 49, to engage and be affixed to the restrictor arm via lock pin 47. The central axle is, as discussed above and below, is capable and intended to enable rotation of the restrictor and actuator arms. It thus forms the axis of rotation for an arcuate path 65 followed by the restrictor and the actuator arm 70 during use of the device. When the arms rotate through the above-described arcuate path, this motion, a reciprocating arc, is transferred, via the central axle, to the rotor. The rotation of the rotor causes the fin thereupon to propel hydraulic fluid through defined and constricted pathways formed by fins mounted upon and disposed radially (and inwardly from) the inner surface of the main housing. The resistance generated by forcing the hydraulic fluid through such constricted pathways provides the resistance to rotation of the actuator arm.

The restrictor arm illustrated in the figures may be described as including a proximal terminus 62, a distal terminus 61 an upper surface 64, a lower surface 66 and two side surfaces 68 & 68'. The restrictor arm illustrated in the figures includes restrictor finger 71 extending from and continuous with the proximal terminus of the restrictor arm. The restrictor finger is shaped and configured so as to extend over an arcuate path 65 during rotation of the restrictor arm which said path lies directly above a series of restrictor pin bores prepared, in a corresponding arch, in the base plate. The restrictor pin bores are configured to accept and retain restrictor pins 17 which, as described above, are utilized to extend upward, above the upper surface of the base plate and intercept the arcuate path of the restrictor finger, thus restricting the arcuate movement of the restrictor and actuator arm 70. It is preferred that the restrictor arm be formed of a high strength material such as aluminum, steel or alloys thereof. However, it is also contemplated that the restrictor arm may be formed of a composite plastic such as, for example, a carbon fiber reinforced plastic or a fiberglass material.

The actuator arm 70 illustrated in the figures is advantageously configured as an elongated bar having a proximal terminus 72, a distal terminus 74, a longitudinal axis extending therebetween, an upper surface 76, a lower surface 78 and two side surfaces 80 & 80'.

It is preferred that the actuator arm be formed of a high strength material such as, for example, steel, aluminum or alloys thereof. It is also possible to form the actuator arm from composite plastic materials such as carbon fiber reinforced plastic and fiberglass materials.

In the preferred embodiment of the present invention illustrated in the figures, side plates 84 & 84' are provided as a means of affixing the actuator arm to the restrictor arm. The side plates are configured as flat elongated plates having an inner 88 and outer 90 broad planar surface, an upper edge 92, a lower edge 94, a proximal terminus 96 and a distal terminus 98. The side plates advantageously include a plurality of bores 100 penetrating through the two broad planar side surfaces which are especially shaped and configured to enable alignment thereof with portions of the side surfaces of the actuator arm to enable fixation therebetween.

In the embodiment illustrated in the figures, the inner broad surface 88 of each side plate 84 & 84', near the distal portion thereof, is affixed to a corresponding side surface of the actuator arm along a proximal portion thereof utilizing assembly bolts 99 which pass through threaded bores 100 located along the overlying portion of the side plates and engage threaded bores formed within assembly plates 107 located along the proximal portion of the two sides of the actuator arm to form a rigid joint. In the preferred embodiment illustrated in the figures, side surfaces of the actuator arm includes a channel in which the assembly plate is slideably inserted. Once the assembly bolts pass through the side plate bores, engage and tighten within the threaded bores of the assembly plates, both the side plates and the assembly plates are firmly affixed to the actuator arm.

In the preferred embodiment of the present invention illustrated in the figures, the proximal portion of the side plates is pivotally joined to the restrictor arm via a pivot bolt 106. More specifically, penetrating through the inner and outer broad surfaces of the side plates, adjacent to the proximal terminus thereof, a pivot bolt bore 108 is prepared which is especially configured and adapted to align with a pivot bore 110 running through and connecting the two side surfaces of the restrictor arm adjacent to the distal portion thereof. Pivot bolt 106 passes through the pivot bolt bore 108 of the side plates and the pivot bore 110 of the restrictor arm to form a pivoting joint between the actuator arm and the restrictor arm. The pivot bolt is secured in such position via a washer 112 and nut 114. A pair of washers 113 enables smoother pivoting action of the actuator arm. Use of a pivot bolt to provide fixation of the actuator arm to the restrictor arm enables the actuator arm to pivot upward through arc 155 so that, as described in more detail below, the angle between a user's forearm and upper arm can be altered when utilizing the device.

In the preferred embodiment of the present invention illustrated in the figures, a pivot bolt is utilized to join the actuator and restrictor arm via a pivoting joint which enables adjustment of the elevation of the actuator arm along arc 172. In addition, the side plates advantageously include, adjacent to the proximal terminus thereof, an elevation lock bore 116 which passes completely through the side surfaces thereof. The elevation lock bore is a hole especially configured and adapted to receive an elevation lock pin 118. The lock bore is also especially configured and prepared to align with a plurality of elevation adjustment bores 120 which pass through the side surfaces of the restrictor arm in an arcuate pattern. The elevation adjustment bores comprise holes prepared through and penetrating the sides of the restrictor arm and which are located proximal to the pivot bolt bore. The elevation bores are prepared so as to align with the elevation lock bore at various positions which correspond with selected elevations of the actuator arm (in relation to the restrictor arm and horizontal plane defined by the upper surface of the base plate). For example, the elevation bores may be situated to provide the actuator arm with an elevation of 0 degrees, 22 degrees and 45 degrees. However, the elevation bores may be prepared to provide any desired increment of elevational angle degree change as well as elevational ranges beyond 45 degrees. Aligning the elevation lock bore prepared in both sides of the restrictor arm with a selected elevation bore—and then passing a elevation lock pin through the lock and elevation bores will thus position and retain the actuator arm in a specific selected elevation. The elevation bores are advantageously marked with numerals corresponding to degrees of elevation.

As discussed above and below, when the device is utilized, a user's elbow lies in an elbow cup and a user's hand grasps a handgrip both of which are mounted upon and extend upward from the upper surface of the actuator arm. With a user grasping the device in this manner, changes in actuator arm elevation cause the angle of the user's forearm and upper arm to change. Elevation adjustments enable a user to set the angle between the upper and lower arm at a desired position or a position as determined by a therapist. In addition, in many instances it is preferable that the user's shoulder directly overly (be plum with) the axis of rotation of the device. In instances where the device is mounted at a height too great, in relation to the user's shoulder, the user's elbow and the angle of rotation will be relatively forward of the shoulder. Increasing actuator elevation is useful in improving this relation.

The elbow cup of the present invention is especially configured and adapted for comfortable and secure placement of a user's elbow therewithin. The elbow cup utilized in the embodiment illustrated in the figures is comprised of an elbow cup shell 122 and an elbow cup insert 124. More specifically, in the preferred embodiment illustrated in the figures, elongated bolt receiver 139 is a flattened and elongated bolt receiver especially shaped and configured to be slideably inserted inside channel 128 (after removal of bolt 136 and plate 134). Elbow cup shell 122 is placed over channel 128 and thereafter two bolt bores 153 especially shaped and configured to enable receipt of bolts 137 are aligned with corresponding threaded bores prepared within the upper surface of elongated bolt receiver 139. Thereafter, the bolts 136 are passed through the elbow cup shell bores so as to matingly engage the threaded bores of the elongated bolt receiver. Thereafter, the position of the elbow cup may be adjusted fore and aft (towards the distal or proximal terminus of the actuator bar, so as to position the elbow as desired and fixed in this position by tightening the bolts. The elbow cup shell provides strength and stability and thus is formed of any suitable material demonstrating sufficient support and rigidity for containment and support of a user's elbow during use of the subject device. Therefore, the elbow cup shell may be formed of a metal or metal alloy such as, for example, aluminum, steel and alloys thereof. In addition, the elbow cup shell may be formed of a thermoplastic material such as a polystyrene, polyvinylchloride, polyester, polycarbonate, polyether or polyurethane plastic. In addition, composite plastics may be utilized. In order to increase user comfort and to improve elbow positional stability an elbow cup insert 124 is fitted to the superior surface of the elbow cup shell and is generally formed from a resilient, pliable material. For example, the insert may be formed of a foam material including open or closed cell foam. The foam may be selected to be a polyurethane, polyethylene or polypropylene rubber foam polyurethane material. In addition, the elbow cup insert may be formed of a natural or synthetic rubber compound. In addition, the elbow cup insert may advantageously be comprised of or include a gel compound utilized for their pressure-distributing characteristics such as, for example, gels based upon polyvinyl chloride, polyorganosiloxanes and polyurethane.

Likewise, the hand grip 126 is shaped adapted and configured for secure grasping by a user's hand. The handgrip may be formed from the same materials, discussed, above, in regard to the elbow cup shell. However, whatever material is utilized to form the handgrip, the material must demonstrate sufficient strength so as to avoid shearing during use. It is also preferred that, in some preferred embodiments of the present invention, that the hand grip include, as an outer layer, a resilient cover formed from the same materials discussed above in regard to the elbow cup insert. Such materials provide superior comfort and enable a user to better grip the handle as such materials include sufficient plasticity to enhance grip.

In the preferred embodiments illustrated in the figures, the handgrip is affixed and positioned along the actuator arm distal to the position of the elbow cup. Both the elbow cup an handgrip are mounted to, positioned upon and extend upward from the the upper surface of the actuator arm. The present invention utilizes adjustable mounting for both the elbow cup and hand grip. For this purpose, the upper surface of the actuator arm may be configured (as described below) to include an adjustment channel 128 along which both the hand grip and elbow cup may be moved along the length of the actuator arm. For example, the hand grip may be moved distally (towards the distal terminus of the actuator arm) to accommodate forearms of greater length. Likewise, the handgrip may be moved proximally (towards the proximal terminus of the actuator arm) so as to accommodate shorter forearms. As used throughout this specification and within the claims, the term "moved distally" is equivalent to "moved fore" and the term "moved proximally" is equivalent to "moved aft". Thus, it may also be said that both the hand grip and elbow cup are mounted, in preferred embodiments, in a manner which allows movement of both a fore and aft direction. Any adjustable fastener such as, for example, a bolt 130 with washer 132 may be utilized to affix the hand grip to a desired position along the superior surface of the actuator arm. For this purpose, the head of T bolt 130 demonstrates a dimension greater than the width of the adjustment channel 128 so as to prevent the head from slipping through the channel and releasing the handle. More specifically, in the embodiment illustrated, the T bolt is introduced into the channel, at the distal end of the actuator arm, by removing actuator plate 134 which is retained by plate bolt 136. Once introduced into the channel, with the bolts head oriented downward and the free threaded end extends upwards, through the channel formed in the upper surface of the actuator bar. Thereafter, the bolt passes through washer 132 and then enters the inferior end 135 of the hand grip which includes a threaded bore 131 formed therein for engagement of the bolt. Therefore, upon engagement of the bolt by rotation of the handle, the handle may be tightened at any desired point along the length of the actuator arm by simply sliding the handle to the desired position and thereafter further rotating the handle so that the washer and bolt firmly engage the track. In the embodiment illustrated in the figures, the elbow cup is affixed to the upper surface of the actuator bar via two bolts 136 at a desired position within the channel. Ordinarily, the elbow cup is positioned so that an elbow placed therein overlies the axis of arcuate motion (and the central axle that forms this axis). However, due to varying dimensions, the distance between the user's elbow and hand is accurately accommodated by adjusting the position of the handgrip. Although, in most instances, the elbow cup will remain aligned with the rotational axis, special circumstances including, but not limited to special therapeutic needs and unusual physical dimensions may require some adjustment of the position of the elbow pad.

The terms and expressions which have been employed in the foregoing specification and in the abstract are used therein as terms of description and not limitation, and there is no intention, in the use of such terms and expressions, of excluding equivalents of the features shown and described or portions thereof, it being recognized that the scope of the invention is defined and limited only by the following claims.

We claim:

1. A highly portable shoulder rehabilitation/exercise device comprised of a base plate, a hydraulic damper, a restrictor arm, an actuator arm, an elbow cup and a hand grip wherein:

the base plate is shaped and configured as a substantially flat plate having a proximal portion, a distal portion, a planar upper and planar lower surface which are parallel to one another, the base plate including a plurality of restrictor bores especially configured and adapted for the receipt of restrictor pins, an axle bore especially configured and adapted for receipt and passage of a central axle of the hydraulic damper through the lower and upper surface of the base plate, the hydraulic damper being mounted to the lower surface of the base plate, the base plate further including a means for affixing the base plate to a stable surface;

the hydraulic damper is comprised of a mounting plate, a main damper housing a central axle, hydraulic fluid, a means of for propelling the hydraulic fluid and a hydraulic fluid flow valve having an aperture, the restrictor arm includes an upper surface, a lower surface, two side surfaces, a proximal and distal terminus with a longitudinal axis extending therebetween, the lower surface of the restrictor arm including a lock bore for receipt of the central axle of the hydraulic damper, the central axle providing an axis of rotation for arcuate motion of the restrictor and actuator arm, the restrictor arm further including a restrictor finger extending from and continuous with the proximal terminus of the restrictor arm, the restrictor finger being especially shaped and configured so that when the restrictor arm moves along an arcuate path, the restrictor finger extends over an arcuate pattern formed by the restrictor bores of the base plate, the restrictor arm further including, adjacent the distal terminus thereof, a means for pivotally affixing the actuator arm to the restrictor arm so as to enable the actuator arm to pivot upward and downward in such a manner as to allow adjustment of elevation of the actuator arm in relation to the restrictor arm;

the actuator arm is configured as an elongated bar having a length, an upper surface, a lower surface, two side surfaces and a proximal and distal terminus with a longitudinal axis extending therebetween, the hand grip and the elbow cup being adjustably mounted upon and extending upward from the upper surface of the actuator arm, the hand grip being mounted distal to the elbow cup;

the elbow cup is shaped and configured to adapt to and engage the elbow of a user and wherein the elbow cup is mounted upon the upper surface of the actuator arm in such a manner so as to allow the elbow cup to be moved fore and aft along the length of the actuator arm so as to obtain a desired position; and the hand grip is shaped and configured to facilitate a user grasping said grip and is mounted upon the upper surface of the actuator arm in such a manner as to allow the hand grip to be moved fore and aft along the length of the actuator arm, so as to obtain a desired position; wherein when a user positions one of user's arms so that an elbow and hand of the arm are positioned so that the elbow is placed within the elbow cup and the hand grasps the hand grip, and, thereafter, the user laterally biases the actuator arm in an inward and outward direction, the actuator arm and the restrictor arm to which it is affixed move along an arcuate path with the central axis of the hydraulic damper being the radial center of such movement, the device thereby positioning the user's arm in such a manner as to enable performance of both internal and external rotations of shoulder without adjusting the device or changing the users position, and wherein, placement of restrictor pins, within one or more restrictor pin bores, enables a user to define and limit the range of motion of the arcuate path, the hydraulic damper, upon which the restrictor arm is mounted, providing smooth, fluid-like resistance to said internal and external rotations of the shoulder which said resistance increases and decreases, automatically, in response to an increase and decrease, respectively, in lateral force applied to the hand grip by the user, the device storing such minimal potential energy and exhibiting such minimal momentum so as to provide substantially no opposition to a user's termination of movement of the actuator arm, the device also providing adjustment to the elevation of a user's forearm so as to attain a desired angular relationship between a user's shoulder, upper and lower arm while said adjustment to elevation also serves as an additional means for adjusting resistance to internal and external rotation of the device.

2. The highly portable shoulder rehabilitation/exercise device of claim 1 wherein the actuator arm is pivotally mounted, adjacent to the proximal terminus thereof, to the restrictor arm so as to enable adjustment in elevation thereof.

3. The highly portable shoulder rehabilitation/exercise device of claim 1 wherein the means for propelling the hydraulic fluid is selected from the group consisting of pistons, vanes and fins.

4. The highly portable shoulder rehabilitation/exercise device of claim 1 wherein the hydraulic damper further includes a means for manually adjusting resistance to arcuate motion provided thereby.

5. The highly portable shoulder rehabilitation/exercise device of claim 3 wherein the means for manually adjusting the resistance to arcuate motion provided by the hydraulic damper comprises an adjustable hydraulic flow valve and adjustment wheel utilized to control the aperture of said valve.

6. The highly portable shoulder rehabilitation/exercise device of claim 1 wherein the device further includes two side plates as a means for affixing the actuator arm to the restrictor arm.

7. The highly portable shoulder rehabilitation/exercise device of claim 6 wherein the device further comprises assembly plates which are slideably fitted and positioned in channels formed within the side surfaces of the actuator arm and wherein the side plates are configured as flat elongated plates having two broad planar surfaces, an upper edge, a lower edge, a proximal terminus and a distal terminus and include a plurality of bores penetrating through the two broad planar side surfaces which are especially shaped and configured to enable alignment thereof with bores formed within assembly plates and the restrictor arm.

8. The highly portable shoulder rehabilitation/exercise device of claim 7 wherein the restrictor arm includes a pivot bore passing through both side surfaces of and adjacent to the distal terminus of the restrictor arm and the proximal portion of the two side plates include corresponding pivot bores that align with the pivot bore of the restrictor arm wherein a pivot bolt, passing through the pivot bores of both side plates and the restrictor arm act as the means for pivotally affixing the restrictor arm to the actuator arm.

9. The highly portable shoulder rehabilitation/exercise device of claim 8 wherein the side plates further include, proximal to the proximate terminus thereof, an elevation lock bore passing therethrough which is especially shaped and configured to align with a plurality of elevation adjustment bores located within and penetrating the side surfaces of the restrictor arm proximal to the pivot bolt bore and the device further includes an elevation lock pin wherein aligning the elevation lock bore prepared in both sides of the restrictor arm with a selected elevation adjustment bore, and thereafter passing the elevation lock pin through the lock and elevation bores retains the actuator arm in a selected elevation.

10. The highly portable shoulder rehabilitation/exercise device of claim 9 wherein three elevation adjustment bores are prepared and arranged so as to enable the restrictor arm to be held by the lock pin at an elevation of 0 degrees, 22 degrees and 45 degrees.

11. The highly portable shoulder rehabilitation/exercise device of claim 1 wherein the base plate includes an arcuate pattern of restrictor bores located within the base plate at positions corresponding to 0, 30, 60 and 90 degrees of inward and outward rotation of the restrictor arm.

12. A highly portable shoulder rehabilitation/exercise device comprised of a base plate, a hydraulic damper, a restrictor arm, an actuator arm, an elbow cup and a hand grip wherein:

the base plate is shaped and configured as a substantially flat plate having a proximal portion, a distal portion, a planar upper and planar lower surface which are parallel to one another, the base plate including a plurality of restrictor bores especially configured and adapted for the receipt of restrictor pins, an axle bore especially configured and adapted for receipt and passage of a central axle of the hydraulic damper through the lower and upper surface of the base plate, the hydraulic damper being mounted to the lower surface of the base plate, the base plate further including a means for affixing the base plate to a stable surface;

the hydraulic damper is comprised of a mounting plate, a main damper housing, a central axle, hydraulic fluid, a means of for propelling the hydraulic fluid and a hydraulic fluid flow valve having an aperture, the restrictor arm includes an upper surface, a lower surface, two side surfaces, a proximal and distal terminus with a longitudinal axis extending therebetween, the lower surface of the restrictor arm including a lock bore for receipt of the central axle of the hydraulic damper, the central axle providing an axis of rotation for arcuate motion of the restrictor and actuator arm, the restrictor arm further including a restrictor finger extending from and continuous with the proximal terminus of the restrictor arm, the restrictor finger being especially shaped and configured so that when the restrictor arm moves along an arcuate path, the restrictor finger extends over an arcuate pattern formed by the restrictor bores of the base plate, the restrictor arm further including, adjacent the terminus thereof, a means for pivotally affixing the actuator arm to the restrictor arm so as to enable the actuator arm to pivot upward and downward in such a manner as to allow adjustment of elevation of the actuator arm in relation to the restrictor arm, wherein the actuator arm is pivotally mounted, adjacent to the proximal terminus thereof, to the restrictor arm so as to enable adjustment in elevation of the actuator arm, the actuator arm is configured as an elongated bar having a length, an upper surface, a lower surface, two side surfaces and a proximal and distal terminus with a longitudinal axis extending therebetween, the hand grip and the elbow cup being adjustably mounted upon and extending upward from the upper surface of the actuator arm, the hand grip being mounted distal to the elbow cup;

the elbow cup is shaped and configured to adapt to and engage the elbow of a user and wherein the elbow cup is mounted upon the upper surface of the actuator arm in such a manner so as to allow the elbow cup to be moved fore and aft along the length of the actuator arm so as to obtain a desired position; and the hand grip is shaped and configured to facilitate a user grasping said grip and is mounted upon the upper surface of the actuator arm in such a manner as to allow the hand grip to be moved fore and aft along the length of the actuator arm, so as to obtain a desired position; wherein when a user positions one of user's arms so that an elbow and hand of the arm are positioned so that the elbow is placed within the elbow cup and the hand grasps the hand grip, and, thereafter, the user laterally biases the actuator arm in an inward and outward direction, the actuator arm and the restrictor arm to which it is affixed move along an arcuate path with the central axis of the hydraulic damper being the radial center of such movement, the device thereby positioning the user's arm in such a manner as to enable performance of both internal and external rotations of the shoulder without adjusting the device or changing the user's position, and wherein, placement of restrictor pins, within one or more restrictor pin bores, enables a user to define and limit the range of motion of the arcuate path, the hydraulic damper, upon which the restrictor arm is mounted, providing smooth, fluid-like resistance to said internal and external rotations of the shoulder which said resistance increases and decreases, automatically, in response to an increase and decrease, respectively, in lateral force applied to the hand grip by the user, the device storing such minimal potential energy and exhibiting such minimal momentum so as to provide substantially no opposition to a user's termination of movement of the actuator arm, the device also providing adjustment to the elevation of a user's forearm so as to attain a desired angular relationship between a user's shoulder, upper and lower arm while said adjustment to elevation also serves as an additional means for adjusting resistance to internal and external rotation of the device.

13. The highly portable shoulder rehabilitation/exercise device of claim 12 wherein the means for propelling the hydraulic fluid is selected from the group consisting of pistons, vanes and fins.

14. The highly portable shoulder rehabilitation/exercise device of claim 13 wherein the hydraulic damper further includes a means for manually adjusting resistance to arcuate motion provided thereby.

15. The highly portable shoulder rehabilitation/exercise device of claim 14 wherein the means for manually adjusting the resistance to arcuate motion provided by the hydraulic damper comprises an adjustable hydraulic flow valve and adjustment wheel utilized to control the aperture of said valve.

16. The highly portable shoulder rehabilitation/exercise device of claim 12 wherein the device further includes two side plates as a means for affixing the actuator arm to the restrictor arm.

17. The highly portable shoulder rehabilitation/exercise device of claim 16 wherein the device further comprises assembly plates which are slideably fitted and positioned in channels formed within the side surfaces of the actuator arm and wherein the side plates are configured as flat elongated plates having two broad planar surfaces, an upper edge, a lower edge, a proximal terminus and a distal terminus and include a plurality of bores penetrating through the two broad planar side surfaces which are especially shaped and configured to enable alignment thereof with a plurality of bores formed within the restrictor arm.

18. The highly portable shoulder rehabilitation/exercise device of claim 17 wherein the restrictor arm includes a pivot bore passing through both side surfaces of and adjacent to the distal terminus of the restrictor arm and the proximal portion of the two side plates include corresponding pivot bores that align with the pivot bore of the restrictor arm wherein a pivot bolt, passing through the pivot bores of both side plates and the restrictor arm act as the means for pivotally affixing the restrictor arm to the actuator arm.

19. The highly portable shoulder rehabilitation/exercise device of claim 18 wherein the side plates further include, proximal to the proximate terminus thereof, an elevation lock bore passing therethrough which is especially shaped and configured to align with a plurality of elevation adjustment bores located within and penetrating the side surfaces of the restrictor arm proximal to the pivot bolt bore and the device further includes an elevation lock pin wherein aligning the elevation lock bore prepared in both sides of the restrictor arm with a selected elevation adjustment bore, and thereafter passing the elevation lock pin through the lock and elevation bores retains the actuator arm in a selected elevation.

20. The highly portable shoulder rehabilitation/exercise device of claim 19 wherein three elevation adjustment bores are prepared and arranged so as to enable the restrictor arm to be held by the lock pin at an elevation of 0 degrees, 22 degrees and 45 degrees.

21. The highly portable shoulder rehabilitation/exercise device of claim 12 wherein the base plate includes an arcuate pattern of restrictor bores located within the base plate at positions corresponding to 0, 30, 60 and 90 degrees of inward and outward rotation of the restrictor arm.

* * * * *